US005590940A

United States Patent [19]

Richard

[11] Patent Number: 5,590,940

[45] Date of Patent: Jan. 7, 1997

[54] SLIDING TIE RACK CABINET FOR DRESSERS

[76] Inventor: Michael B. Richard, 1012 ½ Scott Ave., Port Huron, Mich. 48060

[21] Appl. No.: 572,652

[22] Filed: Dec. 14, 1995

[51] Int. Cl.[6] ..... A47B 81/00

[52] U.S. Cl. ..... 312/287; 312/204; 312/242; 312/245; 312/246; 312/286; 312/321.5; 312/22; 312/25; 312/334.27; 312/334.28; 211/94; 211/162

[58] Field of Search ..... 312/287, 34.1, 312/34.3, 204, 242, 243, 245, 246, 270.1, 270.3, 286, 321.5, 22, 25, 334.27, 334.28; 211/94, 162

[56] References Cited

U.S. PATENT DOCUMENTS

| | | | |
|---|---|---|---|
| 1,121,132 | 12/1914 | Richardson | 312/287 |
| 1,259,345 | 3/1918 | Beecham | 312/334.28 X |
| 1,663,820 | 3/1928 | Sykes | 312/245 X |
| 1,922,215 | 8/1933 | Newberg | 312/246 X |
| 1,981,510 | 11/1934 | Jones . | |
| 2,115,239 | 4/1938 | Strain | 312/287 X |
| 2,917,185 | 12/1959 | Kovacs . | |
| 2,985,311 | 5/1961 | Abel . | |
| 3,124,253 | 3/1964 | Petrich . | |
| 3,317,261 | 5/1967 | Peterson et al. | 312/246 X |
| 3,631,325 | 12/1971 | Wens | 312/334.28 X |
| 3,789,994 | 2/1974 | Koutnik . | |
| 3,874,756 | 4/1975 | Greene | 312/334.24 X |
| 3,897,122 | 7/1975 | McEvers . | |
| 3,954,182 | 5/1976 | McEvers . | |
| 4,108,515 | 8/1978 | Johnson | 211/162 X |
| 4,427,119 | 1/1984 | Savino . | |
| 5,127,721 | 7/1992 | Inden | 312/342 X |
| 5,468,063 | 11/1995 | Simonek | 312/287 X |

OTHER PUBLICATIONS

Dresser Product of Michael Howard of Los Angeles, CA 90040 1 Page Fact Sheet and 2 Photos; Dated About 1992. Model "Encino" Series 8024.

*Primary Examiner*—Peter M. Cuomo
*Assistant Examiner*—Rodney B. White
*Attorney, Agent, or Firm*—Peter D. Keefe

[57] ABSTRACT

A tie rack cabinet which includes a rectilinearly shaped cabinet member having a pheripheral edge wall having a height of at least about that of one-half the length of a standard tie, a back wall connected to and spanning the peripheral edge wall, a tie rack mounted to the peripheral edge wall adjacent the top edge wall thereof; and further includes means for slidingly connecting the cabinet member to a dresser. A tie restraint for preventing flapping of the ties as the tie rack cabinet is slid is provided for each tie at a location remotely spaced from the tie rack. Optionally, loose article receptacles may be connected with the peripheral edge wall for holding various articles such as jewelry, coins, knickknacks, etc. The sliding connection of the cabinet member to the dresser may be integral with the dresser, provided by an opening in a rear portion of a dresser into which the cabinet member is integrated. The sliding connection of the cabinet member to the dresser may be augmentative with the dresser, provided by the tie rack cabinet being slidingly mounted to a housing, the housing being attached to the tear of the dresser. In either case, preferably the tie rack cabinet is selectively slidable in each of left and right sideward directions outwardly at the rear of the dresser.

19 Claims, 4 Drawing Sheets

SLIDING TIE RACK CABINET FOR DRESSERS

BACKGROUND OF THE INVENTION

1. Field of the Invention

The present invention relates to racks used to hold a plurality of men's neck ties. More particularly, the present invention relates to racks of the aforesaid class, wherein the rack is slidable in relation to another structure. Still more particularly, the present invention relates to a tie rack of the aforesaid class which is incorporated into a sliding cabinet which is, in turn, interfaced, internally or augmentarily, with a clothes dresser.

2. Description of the Prior Art

Most men have a large collection of various colors, patterns and styles of neck ties (hereafter referred to simply as "ties"). While a large selection of ties is of great value to a man's wardrobe, it makes no difference how many ties he has if he cannot easily and quickly lock them over and make a selection therefrom while he is dressing. Accordingly, tie racks have been developed wherein a plurality of side-by-side hocks are provided which serve to spread-out the ties in a serial arrangement for ready viewing and easy selection where each tie is foldably placed upon a respective hook.

In order that the ties of a tie rack are most readily made available for selection, some tie racks provide a slidable feature which allows for retractable sliding of the tie rack out from a storage position in a closet (see for example U.S. Pat. Nos.: 2,985,311; 3,124,253; 3,789,994; and 3,954,182).

The concept of a cabinet for holding a tie rack has been addressed to some degree in the art. In this regard, U.S. Pat. No. 3,897,122 describes a cabinet for being mounted in a closet, wherein a door thereof opens to allow passage thereout of tie racks. In this regard further, U.S. Pat. No. 1,981,510 describes a tie rack enclosure supported by arms hanging over a furniture top, wherein a tie rack is slidable thereout and therein past flaps thereof at one end. While these devices are improvements over simple tie racks, they have the problem of a door (or flaps) opening and closing and the ties flapping in the air as the rack is slid.

What remains needed in the art is a tie rack which is resident in a sliding cabinet, a door being obviated thereby, and wherein the sliding cabinet restrains the ties from flapping as the cabinet is slid. What remains further needed in the art is a harmonious integration of a tie rack cabinet having the aforesaid features with respect to a dresser. In this regard, dressers are well known in the art and have long been, and continue to be, a ubiquitous component of bedroom furniture. Typical dressers have three, four, five, or other number of, drawers which slide outwardly to reveal clothes storage areas. Dressers are typically constructed of wood or simulated wood products. What is needed, therefore, is a tie rack cabinet which interfaces harmoniously with the structure and function of a dresser, either as an integral part thereof or as an augmentative part thereof.

SUMMARY OF THE INVENTION

The present invention is a tie rack which is resident in a sliding cabinet member, wherein the sliding cabinet member restrains the ties from flapping as the cabinet member is slid, and wherein the cabinet member interfaces harmoniously with the structure and function of a dresser, either as an integral part thereof or as an augmentative part thereof.

The tie rack cabinet according to the present invention includes a rectilinearly shaped cabinet member having a peripheral edge wall having a height of at least about that of one-half the length of a standard tie, a back wall connected to and spanning the peripheral edge wall, a tie rack mounted to the peripheral edge wall adjacent the top edge wall thereof; and further includes means for slidingly connecting the cabinet member to a dresser. A tie restraint for preventing flapping of the ties as the tie rack cabinet is slid is provided for each tie at a location remotely spaced from the tie rack. Optionally, loose article receptacles may be connected with the peripheral edge wall for holding various articles such as jewelry, coins, knickknacks, etc.

The sliding connection of the cabinet member to the dresser may be integral with the dresser, provided by an opening in a rear portion of a dresser into which the cabinet member is integrated. The sliding connection of the cabinet member to the dresser may be augmentative with the dresser, provided by the tie rack cabinet being slidingly mounted to a housing, the housing being attached to the rear of the dresser. In either case, preferably the tie rack cabinet is selectively slidable in each of left and right sideward directions outwardly at the rear of the dresser.

Accordingly, it is an object of the present invention to provide a tie rack cabinet which harmoniously interfaces with a piece of furniture, such as a dresser.

It is another object of the present invention to provide a tie rack cabinet which harmoniously interfaces integrally with a dresser.

It is a further object of the present invention to provide a tie rack cabinet which harmoniously interfaces with a dresser, wherein a door therefor is obviated.

It is an additional object of the present invention to provide a tie rack cabinet which harmoniously interfaces integrally with a dresser, which provides a restraint for the ties from flapping as the tie rack cabinet is slid.

It is yet another object of the present invention to provide a dresser which is ready for retrofit integral installation of a tie rack cabinet with respect thereto.

It is yet a further object of the present invention to provide a tie rack cabinet which is installable as a harmonious and augmentative part of a dresser.

It is still another object of the present invention to provide a tie rack cabinet which harmoniously interfaces with a dresser, wherein the tie rack cabinet includes provision for holding loose articles.

These, and additional objects, advantages, features and benefits of the present invention will become apparent from the following specification.

DETAILED DESCRIPTION OF THE PREFERRED EMBODIMENT

Figure 1:
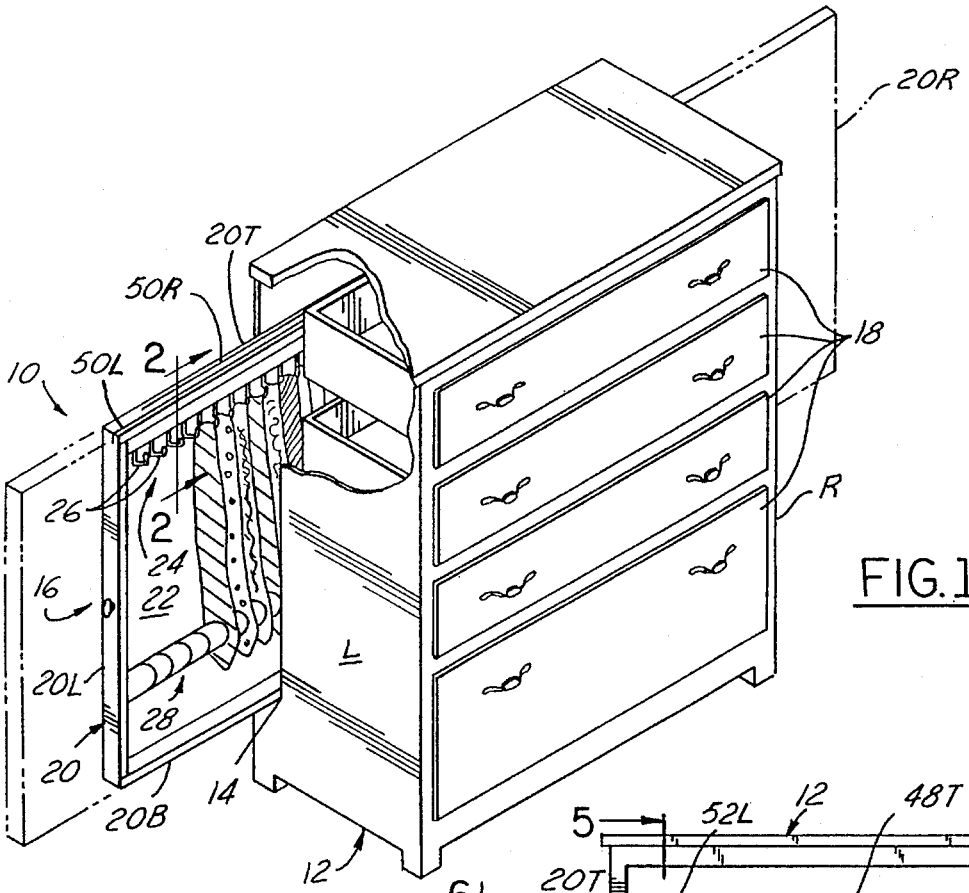
FIG. 1 is a perspective view of a dresser having an integrally installed tie rack cabinet according to the present invention.

Referring now to the Drawing, FIG. 1 depicts the tie rack cabinet 10 according to the present invention in operation with respect to a dresser 12. The tie rack cabinet 10 is integrally installed with respect to the dresser 12, wherein an opening 14 is provided on each of the left and right sides L, R of the dresser so that the cabinet member 16 of the tie rack cabinet is selectively slidable out of the dresser from either the left or right sides thereof. It will be noted that the dresser 12 is in every way functionally unaffected by the installation of the tie rack cabinet 10, in that the rear of the dresser drawers 18 thereof are spaced from the tie rack cabinet even when the dresser drawers are fully retracted into the dresser, as shown in FIG. 1 (see also FIG. 5). Thus, the tie rack cabinet 10 is slidable in relation to the dresser 12 without any interference by the dresser drawers 18.

The tie rack cabinet 10 includes upper and lower roller guides (see for example FIG. 5) for slidingly mounting the cabinet member 16 to the dresser 12 and which further define the limits of sliding travel of the cabinet member relative to the dresser, the structural details of which will be recounted hereinbelow. In this regard, the cabinet member 16 includes a peripheral edge wall 20 and a back wall 22 connected thereto, wherein top and bottom edge walls 20T, 20B of the peripheral edge wall 20 engage with respect to the upper and lower roller guides, and wherein left and right edge walls 20L, 20R of the peripheral edge wall appear to form a portion of the dresser sides L, R when the cabinet member is retracted into the dresser whereby the left and right edge walls are flush with the left and right sides, respectively.

Figure 7:
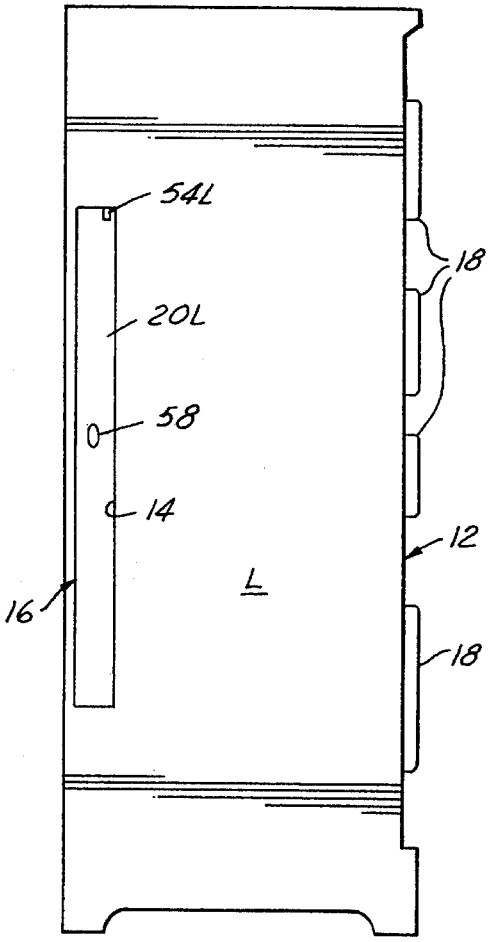
FIG. 7 a side view of a dresser integrally having the tie rack cabinet according to the present invention, wherein the cabinet member thereof is shown flush with the side of the dresser.

The left and right edge walls 20L, 20R have an edgewise dimension that closely approximates that of the openings 14 (see for example FIG. 7). Accordingly, the cabinet member 16 locks like part of the dresser 12 when fully retracted into the dresser, whereupon the left and right edge walls 20L, 20R are flush with the left and right sides L, R of the dresser. In this regard as well, the peripheral edge wall 20 is surfaced to match the surface of the dresser to thereby enhance the integrated look.

A tie rack 24 is mounted to the peripheral edge wall 20 (and/or the back wall 22), wherein a plurality of hocks 26 are provided over which a tie is hungably draped more-or-less at its midsection. A tie restraint 28 is connected with the peripheral edge wall 20 (and/or the back wall 22) remotely from the tie rack 22 to thereby prevent flapping of ties when the cabinet member 16 is slid.

Figure 2:
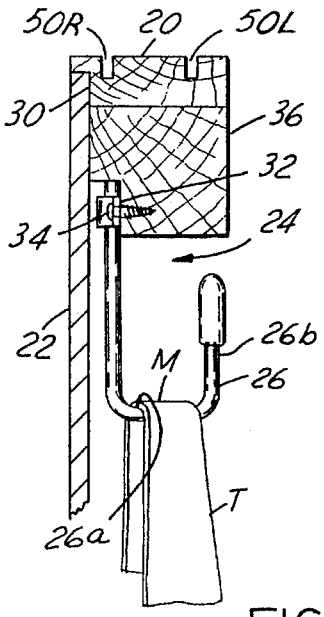
FIG. 2 is a partly sectional end view seen along line 2—2 in FIG. 1 of a tie rack of the cabinet member of the tie rack cabinet according to the present invention, shown in operation holding a tie.
Figure 3:
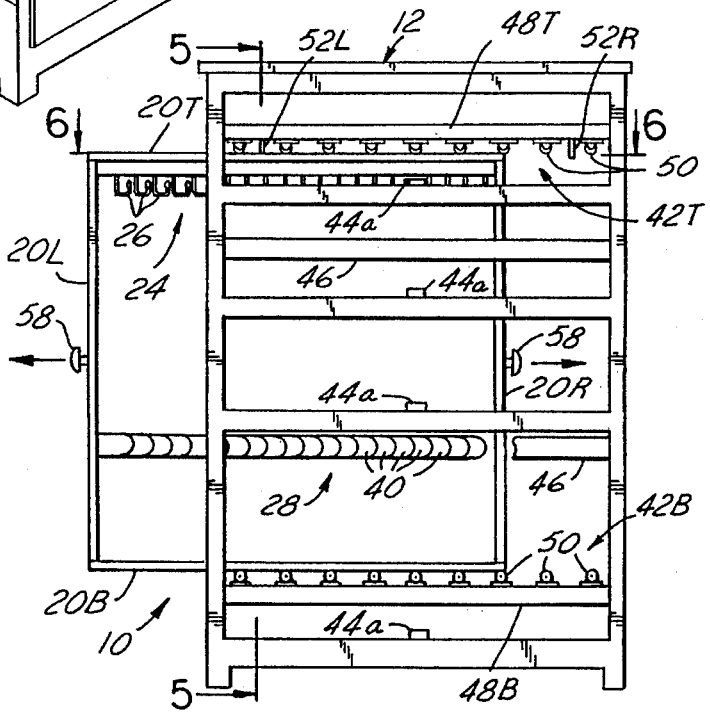
FIG. 3 is a front view of a dresser having an integrally installed tie rack cabinet according to the present invention, the drawers of the dresser having been removed for clarity of depiction.

Referring now to FIG. 3, the cabinet member 16 is generally rectilinear near in shape as defined by the peripheral side wall 20. A preferred material for the peripheral side wall 20 is wood, but simulated wood products, such as pressed particle board having a woodgrain veneer, or other materials such as plastic, are acceptable depending upon the look and type of the dresser 12 to which the cabinet member is to interface. The back wall 22 is composed of a thin, stiff material, such as for example coated cardboard, plastic, plywood, particle board or pressed fiber board, such as MARLITE (a trademark product), of about one-eighth inch thickness. Preferably, the peripheral edge wall 20 is provided with a groove 30 having a depth equal to the thickness of the back wall for seating flush the back wall 22, as shown in FIG. 2. The back wall 22 may be nailed, glued or otherwise connected fixedly to the peripheral edge wall 20. The groove ensures that the overall depth of the cabinet member 16 is minimal and the appearance of the left and right edge walls 20L, 20R is unaffected by the presence of the back wall.

An example of construction of the cabinet member 16 will now be given for illustrative purposes only. Wood is used for the peripheral edge wall 20 in the form of wood frame pieces of three quarter inch width and one and one-eighth inch depth (thereby defining the overall depth of the cabinet member at one and one-eighth inch). The overall size of the cabinet member defined by the peripheral edge wall 20 is thirty-four inches by thirty-four inches. The back wall 22 is a pressed fiber board having a thickness of one-eighth inch. With the back wall 22 seated in its groove 30, the interior depth of the cabinet member 16 is one inch. The tie rack 24 and the tie restraint 28 are as shown in FIG. 3, are obtained commercially, and are both located entirely within the interior depth.

As shown in FIGS. 1, 2 and 3, the tie rack 24 is composed of a series of hooks 26 which are interconnected by a rack member 32. The rack member 32 is preferably connected to the peripheral edge wall 20. This connection is preferably provided as shown in FIG. 2, wherein a the rack member 32 is held by screws 34 to an L-shaped facia board 36 which is, in turn, connected to the peripheral edge wall 20 adjacent the top edge wall 20T. Each of the hooks 26 is generally L-shaped and provides a horizontal tie rest **26*a* over which a tie T is drapably hung by being folded more-or-less at its midsection M. For example, the tie rest 26*a* may be spaced from the facia board, via a vertical portion thereof, about 1.5 inches and have, itself, a length of about 1.5 inches. It is preferred for the tie rest 26*a* to be oriented substantially parallel with respect to the top edge wall 20T and be further oriented at an acute angle, most preferably about 15 to 30 degrees, with respect to the back wall 22. The tie rest 26*a* of each hock 26 ends at a vertically upstanding tie stop 26*b* which prevents the tie draped thereon from accidentally slipping thereoff in a direction parallel with the tie rest, The hocks 26 are situated within the interior depth of the cabinet member 16. The hooks 26 are mutually spaced to provide a close proximity, serial arrangment of the ties T, wherein the acute angle of the hooks allows for easy inspection and selection thereof. The spacing between the tie rest 26*a* of the hooks 26 and the bottom edge wall 20B** is at least about one-half the length of a standard tie.

Figure 4:
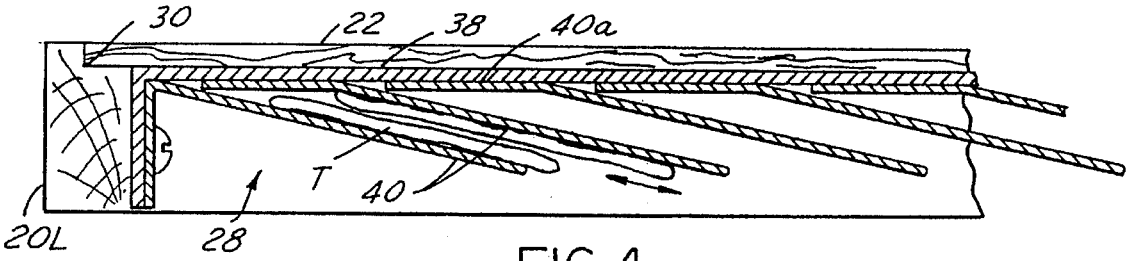
FIG. 4 is a partly sectional view along line 4—4 in FIG. 3 of a tie restraint of the cabinet member according to the present invention.

As shown by FIGS. 1, 3 and 4, the tie restraint 28 is located remotely from the tie rack 24, more-or-less near the bottom portion of the hung ties T; for example, about two-thirds the distance from the tie rack to the bottom edge wall 20B as measured from the tie rack. The tie restraint 28 provides an interfering abutment for the hung ties T so that the portion thereof depending from their respective hooks 26 cannot flap or fly outwardly from the confines of the interior depth defined by the peripheral edge wall 20 as the cabinet member 16 is slid.

Figure 10:
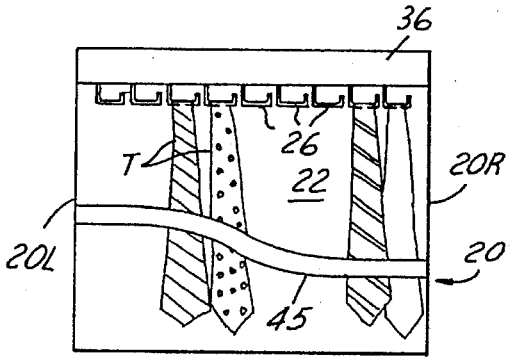
FIG. 10 is a front view of a cabinet member according to the present invention having an alternative tie restraint.

The preferred tie restraint 28 is best shown in FIG. 4, which is composed of a mounting bracket 38 and a plurality of spaced louvers 40, one louver for each hock 26, wherein each louver is located vertically below its respective hook. The louvers 40 are located within the interior depth of the cabinet member 16 and are connected to the mounting bracket 38, such as for example by a base portion 40*a* thereof being spot welded. The mounting bracket 38 is connected for example by screws to the peripheral edge wall 20. The louvers are angled at between about 15 and 30 degrees with respect to the mounting bracket 38 in a selected horizontal alignment direction (shown to the right in FIG. 4), preferably substantially at the same acute angle as the hooks 26, so that a tie may be slid along arrow A therebetween and each tie is clearly visible even though they are closely side-by-side. In operation, the lower portion of a hung tie T is slid along arrow A into its respective louver to thereby hold it into proximity with the back wall 22 in vertical relation to its respective hook 26. When removing the tie T from the cabinet member 16, it is lifted off its hook and either slid out along arrow A from its louver, or else it is lifted therefrom (or some combination thereof). An alternative tie restraint 28 in the form of a cross-band 45 spanning between the left and right edge walls 20L, 20R and spaced from the back wall 22 within the interior depth of the edge wall 20 is shown in FIG. 10.

As best seen in FIG. 3, the cabinet member 16 is rollingly guided by top and bottom roller guides 42T, 42B which are connected fixedly to the dresser 12 for rollingly interfacing with the top and bottom edge walls 20T, 20B of the cabinet member 16. The exact structural features to accomplish this installation with respect to a dresser 12 are shown in FIG. 5.

Figure 5:
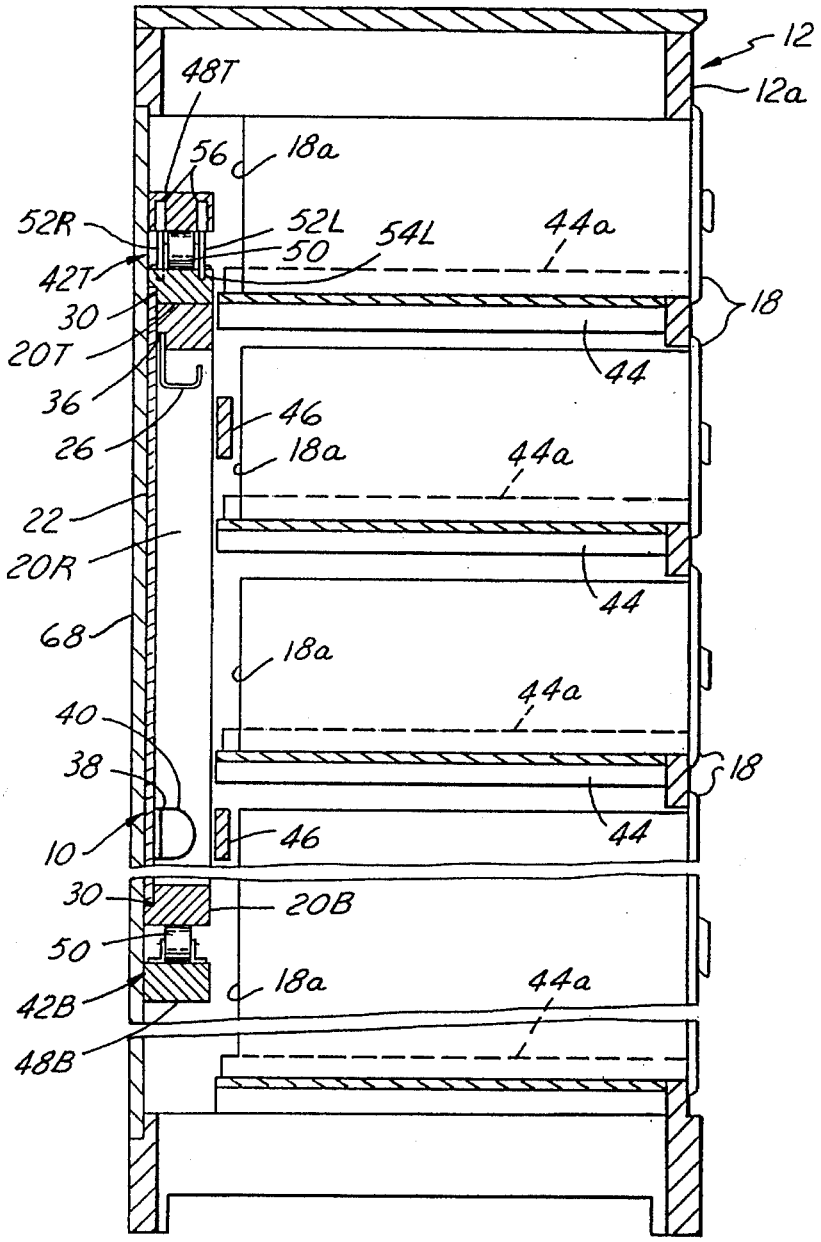
FIG. 5 is a partly sectional end view of the tie rack cabinet and its integral installation relative to a dresser, shown along line 5—5 in FIG. 3.

As shown in FIG. 5, each drawer 18 of the dresser 12 is provided with a drawer support 44 which includes a drawer guide 44*a*. While various dresser constructions may differ, nonetheless, some provision for drawer support, and usually guidance, is present, The rear 18*a* of each of the drawers 18 is spaced from the cabinet member 16 when they are retracted into the dresser 12; accordingly, the drawers do not in any way affect operation of the tie rack cabinet 10. In order to, at least in part, provide guidance for sliding movement of the cabinet member 16, it is preferred to include guides 46 which abut the peripheral wall 20 and which are transversely connected between the left and right sides L, R of the dresser 12 for this purpose; however, the drawer support 44 (and/or its associated drawer guide 44*a*) may be structured to terminate closely adjacent the cabinet member 16 and thereby serve as internal guidance for its sliding movements.

As mentioned hereinabove with respect to FIG. 7, and as further shown by FIG. 5, the peripheral edge wall 20 has an edgewise dimension that closely approximates that of the openings 14. In this regard, the front-to-back guidance of the cabinet member 16 is provided by the openings 14 abutting the peripheral edge wall 20, as well as the peripheral edge wall being abuttingly situated between the back board 68 of the dresser 12 and the guides 46. Accordingly, the slidable movement of the cabinet member 16 is thereby guided align ably with respect to the openings 14. Alternatively, sideways roller guidance (ie., at 90 degrees to the top and bottom roller guides) could be provided between the dresser and the peripheral edge wall.

The top and bottom roller guides 42T, 42B are composed of top and bottom base members 48T, 48B (which may be for example wooden boards) to which is connected a plurality of spaced rollers 50. The rollers 50 of the top roller guide 42T contact the top edge wall 20T and the rollers 50 of the bottom roller guide 42B contact the bottom edge wall 20B. The top and bottom base members 48T, 48B are each connected to the frame 12*a* of the dresser 12 at a horizontal attitude. As a result of this top and bottom roller interface, the cabinet member 16 is slidable in relation to the dresser 12 and is stable without tilting even when pulled out from the dresser a considerable portion of its breadth (as measured between the left and right edge walls 20L, 20R).

Figure 6:
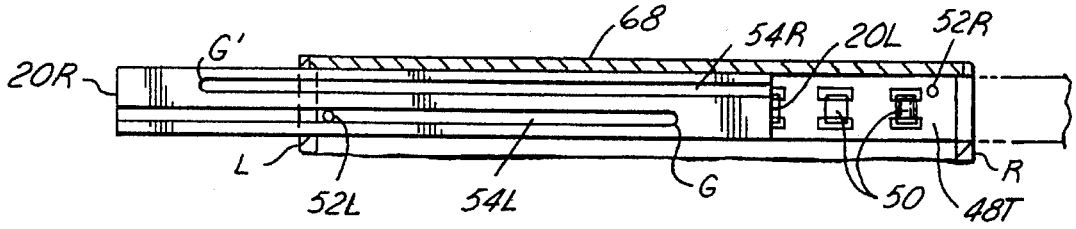
FIG. 6 is a partly sectional view along line 6—6 in FIG. 3, showing the reciprocation travel limiter of the cabinet member according to the present invention.

In order to regulate travel of the cabinet member 16 in relation to the dresser 12, left and right guide pins 52L, 52R are connected with the top base member 48T which are received into respective left and right guide slots 54L, 54R formed in the top edge wall 20T. As can be best seen in FIG. 6, the left guide pin 52L is received in the left guide slot 54L, and, since the left guide slot begins at the left edge wall 20L and terminates at a terminous G remote (for example about five inches) from the right edge wall 20R, the cabinet member 16 can be slid outward from the dresser at the left side L thereof to a maximum extent defined by the terminous G of the left guide slot (ie., in the aforementioned five inch example, assuming the left guide pin 52L is near the left side L of the dresser, the cabinet member would have a little over five inches still within the dresser). Analogously, the right guide pin 52R is received in the right guide slot 54R, and, since the right guide slot begins at the right edge wall 20R and terminates remote at a terminous G' (for example about five inches) from the left edge wall 20L, the cabinet member 16 can be slid outward from the dresser at the right side R thereof to a maximum extent defined by the terminous G' of the right guide slot (ie., in the aforementioned five inch example, assuming the left guide pin 52L is near the left side L of the dresser, the cabinet member would have a little over five inches still within the dresser).

In order to get the left and right guide pins 52L, 52R into their respective left and right guide slots 54L, 54R, the left and right guide pins are each anchored within the top base member 48T via spring loaded mechanisms 56, whereby the left and right guide pins are temporarily held by the installer in a retracted state as the cabinet member 16 is first installed into the dresser 12. As shown in FIG. 5, the left and right guide pins 52L, 52R are located on either side of the rollers 50. As shown in FIGS. 3 and 7, a knob 58 is provided on each of the left and right edge walls 20L, 20R to enable a user to easily pull thereupon to thereby slidably open the cabinet member 16 in relation to the dresser 12.

Figure 8:
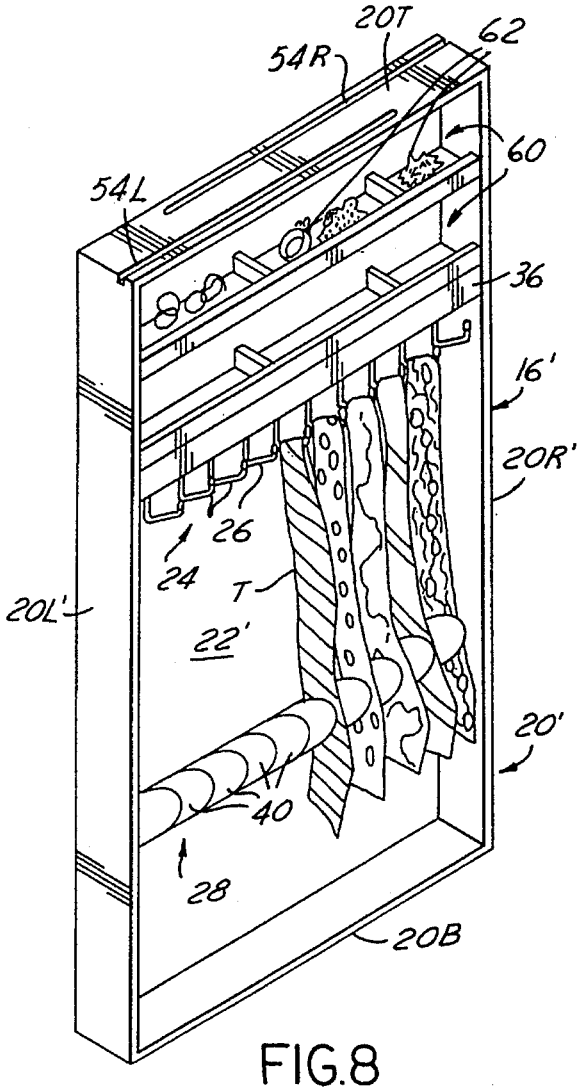
FIG. 8 is a perspective view of the cabinet member according to the present invention, wherein loose article holders are provided.

As shown in FIG. 8, the cabinet member 16' is modified to include loose article receptacles 60 for storing loose articles 62. In this regard, it is preferred to vertically extend the left and right edge walls 20L', 20R' while keeping the top and bottom edge walls 20T, 20B the same size; the back wall 22' is dimensioned to span the modified edge wall 20'. The facia board 36 is now located spaced from the top edge wall 20T, whereby the loose article receptacles 60 are located therebetween. The tie rack 24 and the tie restraint 28 are as described hereinabove, and function as stated with respect to the ties T. The loose article receptacles 60 may be in the form of shelves with a front lip, may include dividers, and may include drawers and or doors such as that used in jewelry boxes. The loose article receptacles 60 are connected with the edge wall 20'. Sliding interface with a dresser via the aforementioned top and bottom roller guides is as described hereinabove.

Figure 9:
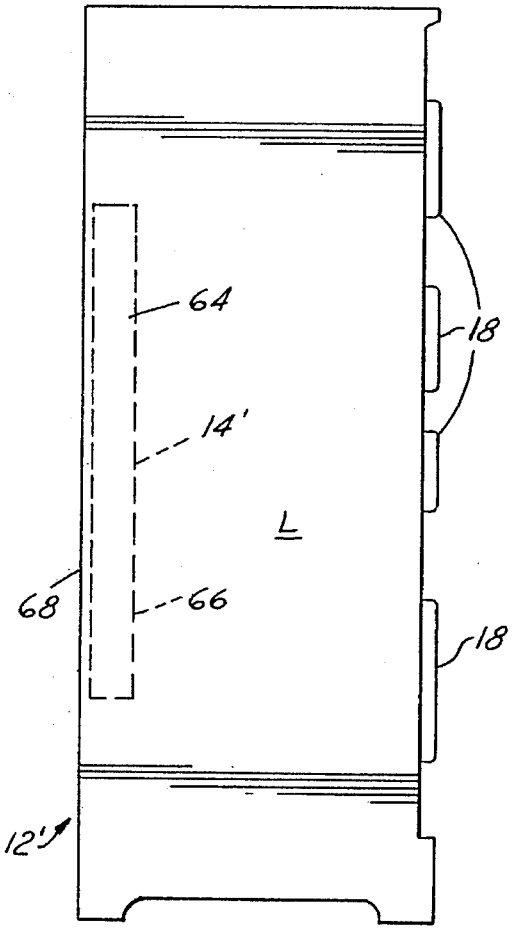
FIG. 9 is a side view of a dresser having a predetermined punch-out opening panel in the side thereof for retrofit integral installation of the tie rack cabinet according to the present invention.

FIG. 9 depicts a dresser 12' which is manufactured for being easily retrofitted with the tie rack cabinet 10. In this regard, in the least, a punch-out opening panel 64 is provided in the left and right sides of the dresser 12', and pre-drilled holes are also preferably provided for installing the guides 46 (if needed) and the top and bottom roller guides 42T, 42B. The punch-out opening panel feature is provided by perforations or scoring 66 along the perimeter of the opening 14', whereby the perforations or scoring are inside, ie., internal to the exterior face of the left and right sides L, R of the dresser 12'. Thus, it is not apparent to the onlooker that the punch-out opening panel feature is present. As an example of operation, the back board 68 of the dresser is removed (such as by removing its mounting screws) and then a knee is run along the inside scoring to cut all the way through the side of the dresser, whereupon the punch-out opening panel 64 is removed to reveal the opening 14'. In addition to the punch-out opening panels 64, it is preferred to include the guides 46 pre-installed with the dresser (if needed for the retrofitting). It is preferred to include the top and bottom guide rollers 42T, 42B as part of a retrofit kit included with the cabinet member 16, 16'; alternatively, the top and bottom guide rollers can also be pre-installed in the dresser.

It is to be noted that in order to minimize the space taken-up by the cabinet member 16, 16', the openings 14, 14' should be located as close as is feasible to the back board 68, whereby optimized is the space between the back board and the rear 18*a* of the drawers 18 when they are fully retracted into the dresser 12, 12'.

In operation, the user grasps and pulls upon the knob 58 to thereby cause the cabinet member 16, 16' to slide out from the dresser 12. The ties T will now be clearly visible and selection is readily accomplished by simply taking the tie off of its hook and sliding it out of the tie restraint, The cabinet member is then pushed back into the dresser. At the end of the day, the selected tie is put back onto its hook and behind its tie restraint after the cabinet member has been again slid out from the dresser. During this process, no doors had to be opened or closed and the ties remained neatly arranged and substantially motionless as the cabinet member was slid.

Figure 11:
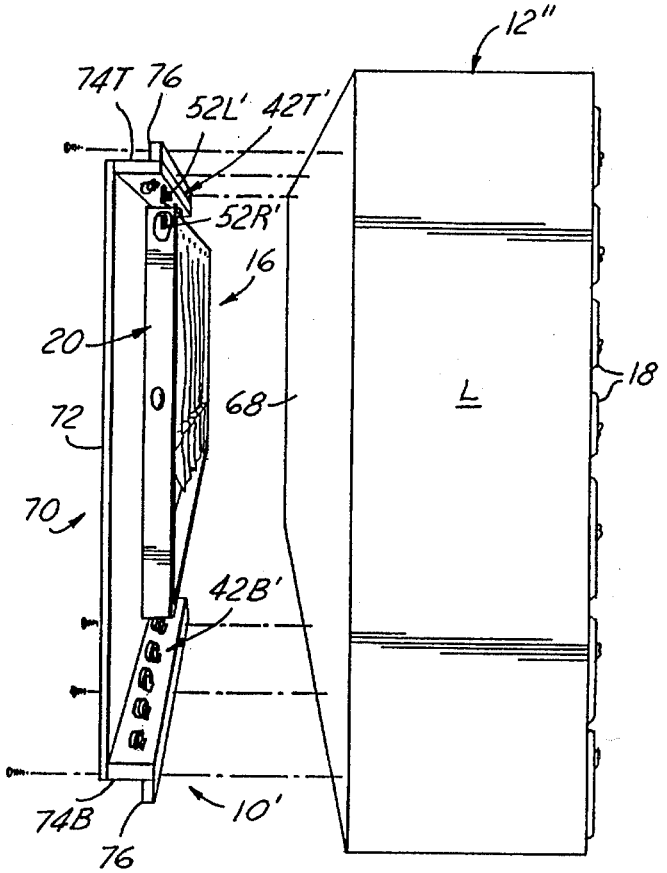
FIG. 11 is a perspective view of an alternative tie rack cabinet shown about to be augmentatively installed to the rear side of a dresser.

FIG. 11 depicts an alternative configuration of the tie rack cabinet 10' wherein mounting is augmentative with respect to a dresser 12". The tie rack cabinet 10' includes a cabinet member 16, as shown, or a cabinet member 16' which has the loose article receptacles 60 (as depicted in FIG. 8) and further includes a housing 70. The construction and operation of the cabinet member 16, 16' has been described in detail hereinabove so that no further elaboration is needed here. The housing 70 is mounted to the back board 68 and/or the frame of the dresser 12" and provides a rolling mounting interface for the cabinet member 16, 16' with respect to the dresser.

The housing 70 includes a back panel 72 composed of a stiff material, such as used for the back wall 22 of the cabinet member 16, 16'. A top end wall 74T is connected to the top end of the back panel 72, and a bottom end wall 74B is connected to the bottom end of the back panel. A mounting flange 76 is connected to each of the top and bottom end walls 74T, 74B, whereby screws 78 connect the mounting flanges to the back board 68 and/or the frame of the dresser 12".

A top roller guide 42T' and a bottom roller guide 42B' are connected, respectively, to the top end wall 74T and the bottom end wall 74B. The top edge wall 20T rollingly engages the top roller guide 42T', while the bottom edge wall 20B rollingly engages the bottom roller guide 42B' in the manner hereinabove described with respect to the cabinet member 16, 16' and the top and bottom roller guides 42T, 42B. The top end wall 74T also includes guide pins 52L', 52R' which interface guidably with the guides slots (as shown in FIG. 8) of the cabinet member 16, 16' to thereby define the limits of travel of the cabinet member with respect to the housing. The width of the top and bottom end walls 74T, 74B is such that the cabinet member 16, 16' is slidingly guided abuttably between the back panel 72 and the back board 68.

To those skilled in the art to which this invention appertains, the above described preferred embodiment may be subject to change or modification. For example, while the present invention is shown installed with respect to a dresser, it is possible to similarly install the tie rack cabinet with respect to other furniture pieces. Further for example, the travel limitation feature may interface with either or both the top and bottom edge walls. Such change or modification can be carried out without departing from the scope of the invention, which is intended to be limited only by the scope of the appended claims.

What is claimed is:

1. A tie rack cabinet for being installed with respect to a furniture piece, said tie rack cabinet comprising:

a cabinet member comprising:

a peripheral edge wall comprising a top edge wall, a bottom edge wall opposite said top edge wall, a left edge wall connected with said top and bottom edge walls, and a right edge wall opposite said left edge wall, said right edge wall being connected with said top and bottom edge walls;

a back wall connected to said peripheral edge wall, said back wall spanning said peripheral edge wall, said back wall and said peripheral edge wall collectively defining an interior depth of said cabinet member;

tie rack means connected with at least one of said peripheral edge wall and said back wall for holding a plurality of ties serially in predetermined spaced relation between said left and right edge walls;

tie restraint means connected with at least one of said peripheral edge wall and said back wall at a location remote from said tie rack means for preventing said ties from flapping when said cabinet member is slidably moved;

roller guide means for rollingly interfacing with said peripheral edge wall; and means for connecting said roller guide means to a selected furniture piece to thereby provide sliding movability of said cabinet member with respect to the selected furniture piece within preselected limits of travel;

wherein said tie rack means comprises a plurality of hooks having a tie rest oriented substantially parallel with respect to said top edge wall and having an acute angle with respect to said back wall.

2. The tie rack cabinet of claim 1, further comprising loose article receptacles connected with at least one of said peripheral edge wall and said back wall, said loose article receptacles being located within said interior depth.

3. The tie rack cabinet of claim 1, wherein tie stop means connected with said tie rest means of each said hook for holding a tie hung thereupon from sliding off in a direction parallel with respect to said tie rest.

4. The tie rack cabinet of claim 1, wherein said tie restraint means comprises a plurality of louvers, one louver respectively for each said hook, said louvers being oriented substantially at said acute angle with respect to said back wall.

5. The tie rack cabinet of claim 1, wherein said tie rack means and said tie restraint means are each located within said interior depth.

6. The tie rack cabinet of claim 5, wherein said peripheral edge wall has a groove into which is flushly seated said back wall.

7. The tie rack cabinet of claim 5, further comprising loose article receptacles connected with at least one of said peripheral edge wall and said back wall, said loose article receptacles being located within said interior depth and between said top edge wall and said tie rack means.

8. A tie rack cabinet for being installed with respect to a furniture piece, said tie rack cabinet comprising:

a cabinet member comprising:

a peripheral edge wall comprising a top edge wall, a bottom edge wall opposite said top edge wall, a left edge wall connected with said top and bottom edge walls, and a right edge wall opposite said left edge wall, said right edge wall being connected with said top and bottom edge walls;

a back wall connected to said peripheral edge wall, said back wall spanning said peripheral edge wall, said back wall and said peripheral edge wall collectively defining an interior depth of said cabinet member;

tie rack means connected with at least one of said peripheral edge wall and said back wall for holding a plurality of ties serially in predetermined spaced relation between said left and right edge walls;

tie restraint means connected with at least one of said peripheral edge wall and said back wall at a location remote from said tie rack means for preventing said ties from flapping when said cabinet member is slidably moved; and a housing for slidably interfacing said cabinet member with a piece of furniture, said housing comprising:

a back wall having a top end, a bottom end, a left side and a right side;

a top end edge wall connected to said top end of said back wall;

a bottom end wall connected to said bottom end of said back wall;

top roller guide means connected with said top end wall for rollingly interfacing with said top edge wall of said cabinet member;

bottom roller guide means connected with said bottom end wall for rollingly interfacing with said bottom edge wall of said cabinet member;

means for defining sliding travel limits of said cabinet member with respect to said housing; and means for connecting said housing to a selected furniture piece to thereby provide sliding movability of said cabinet member guidably with respect to the selected furniture piece.

9. The tie rack cabinet of claim 8, further comprising loose article receptacles connected with at least one of said peripheral edge wall and said back wall, said loose article receptacles being located within said interior depth.

10. The tie rack cabinet of claim 8, wherein said tie rack means comprises a plurality of hooks having a tie rest oriented substantially parallel with respect to said top edge wall and having an acute angle with respect to said back wall.

11. The tie rack cabinet of claim 10, wherein tie stop means connected with said tie rest means of each said hook for holding a tie hung thereupon from sliding off in a direction parallel with respect to said tie rest.

12. The tie rack cabinet of claim 10, wherein said tie restraint means comprises a plurality of louvers, one louver respectively for each said hook, said louvers being oriented substantially at said acute angle with respect to said back wall; and wherein said tie rack means and said tie restraint means are each located within said interior depth.

13. The tie rack cabinet of claim 10, wherein said means for defining sliding travel limits comprises:

a left guide pin connected with at least one of said top end wall and said bottom end wall;

a right guide pin connected with at least one of said top end wall and said bottom end wall;

a left guide slot formed in said peripheral edge wall for guidably receiving said left guide pin; and a right guide slot formed in said peripheral edge wall for guidably receiving said right guide pin;

wherein said left guide slot has a first predetermined elongation which thereby, in cooperation with said left guide pin, defines a travel limit of said cabinet member with respect to movement outwardly from said left side of said housing; and wherein said right the slot has a second predetermined elongation which thereby, in cooperation with said right guide pin, defines a travel limit of said cabinet member with respect to movement outwardly from said right side of said housing.

14. A dresser and tie rack cabinet comprising:

a dresser having a back board, a left side, a rear side, and a plurality of drawers, each drawer of said plurality of drawers having a rear, each of said left and right sides having a respective opening;

a cabinet member comprising:

a peripheral edge wall comprising a top edge wall, a bottom edge wall opposite said top edge wall, a left edge wall connected with said top and bottom edge walls, and a right edge wall opposite said left edge wall, said right edge wall being connected with said top and bottom edge walls, said left and right edge wall having an edgewise dimension;

a back wall connected to said peripheral edge wall, said back wall spanning said peripheral edge wall, said back wall and said peripheral edge wall collectively defining an interior depth of said cabinet member, wherein said peripheral edge wall has a groove into which is flushly seated said back wall;

tie rack means connected with at least one of said peripheral edge wall and said back wall for holding a plurality ties serially in predetermined spaced relation between said left and right edge walls;

tie restraint means connected with at least one of said peripheral edge wall and said back wall at a location remote from said tie rack means for preventing said ties from flapping when said cabinet member is slidably moved;

top roller guide means connected with said dresser for rollingly interfacing with said top edge wall of said cabinet member;

bottom roller guide means connected with said dresser for rollingly interfacing with said bottom wall of said cabinet member;

means for defining sliding travel limits of said cabinet member with respect to said left and right sides of said dresser; and means for guiding sliding movement of said cabinet member alignably with respect to each said opening of said left and right sides;

wherein each said opening is dimensioned substantially similar to said edgewise dimension of said left and right side edge walls; and wherein said peripheral edge wall is dimensioned such that said left and right edge walls are flush with respect to said left and right sides when said cabinet member is fully retracted within said dresser.

15. The tie rack cabinet and dresser of claim 14, further comprising loose article receptacles connected with at least one of said peripheral edge wall and said back wall, said loose article receptacles being located within said interior depth.

16. The tie rack cabinet and dresser of claim 14, wherein said tie rack means comprises a plurality of hooks having a tie rest oriented substantially parallel with respect to said top edge wall and having an acute angle with respect to said back wall.

17. The tie rack cabinet and dresser of claim 14, wherein said tie restraint means comprises a plurality of louvers, one louver respectively for each said hock, said louvers being oriented substantially at said acute angle with respect to said back wall;

wherein said tie rack means and said tie restraint means are each located within said interior depth.

18. The tie rack cabinet and dresser of claim 14, wherein said means for defining sliding travel limits comprises:

a left guide pin connected with at least one of said top edge wall and said bottom edge wall;

a right guide pin connected with at least one of said top edge wall and said bottom edge wall;

a left guide slot formed in said peripheral edge wall for guidably receiving said left guide pin; and a right guide slot formed in said peripheral edge wall for guidably receiving said right guide pin;

wherein said left guide slot has a first predetermined elongation which thereby, in cooperation with said left guide pin, defines a travel limit of said cabinet member with respect to movement outwardly from said left side of said dresser; and wherein said right guide slot has a second predetermined elongation which thereby, in cooperation with said right guide pin, defines a travel limit of said cabinet member with respect to movement outwardly from said right side of said dresser.

19. A dresser pre-retrofit provision for installation of a tie rack cabinet, wherein the tie rack cabinet comprises: a cabinet member comprising: a peripheral edge wall comprising a top edge wall, a bottom edge wall opposite said top edge wall a left edge wall connected with said top and bottom edge walls, and a right edge wall opposite said left edge wall, said right edge wall being connected with said top and bottom edge walls, said left and right edge walls having an edgewise dimension; a back wall connected to said peripheral edge wall, said back wall spanning said peripheral edge wall, said back wall and said peripheral edge wall collectively defining an interior depth of said cabinet member; tie rack means connected with at least one of said peripheral edge wall and said back wall for holding a plurality ties serially in predetermined spaced relation between said left and right edge walls; tie restraint means connected with at least one of said peripheral edge wall and said back wall at a location remote from said tie rack means for preventing said ties from flapping when said cabinet member is slidably moved; roller guide means for rollingly interfacing with said peripheral edge wall; means for guiding sliding movement of said cabinet member with respect to said dresser; and means for connecting said roller guide means to the dresser to thereby provide sliding movability of said cabinet member with respect to the dresser within preselected limits of travel, said dresser comprising:

a left side a right side opposite said left side;

said left side having a left side punch-out opening panel having a predetermined dimension;

said right side having a right side punch-out opening panel having said predetermined dimension;

a back board connected with said right and left sides, wherein said back board is located substantially adjacent said left and right punch-out opening panels; and a plurality of drawers, each drawer of said plurality of drawers having a rear spaced a predetermined distance from said back board;

wherein said predetermined dimension is similar to the edgewise dimension of the cabinet member; and wherein said predetermined distance is sufficient to locate said cabinet member between said back board and said rear of each said drawer when each said drawer is fully retracted into said dresser.

* * * * *